United States Patent [19]

Petersson

[11] Patent Number: 4,514,217

[45] Date of Patent: Apr. 30, 1985

[54] METHOD OF PRODUCING LEAD FROM SULPHIDIC LEAD RAW-MATERIAL

[75] Inventor: Stig A. Petersson, Skelleftehamn, Sweden

[73] Assignee: Boliden Aktiebolag, Stockholm, Sweden

[21] Appl. No.: 608,948

[22] Filed: May 10, 1984

[30] Foreign Application Priority Data

May 17, 1983 [SE] Sweden ..... 8302764

[51] Int. Cl.[3] ..... C22B 4/04; C22B 13/00

[52] U.S. Cl. ..... 75/10 R; 75/77

[58] Field of Search ..... 75/77, 10 R

[56] References Cited

U.S. PATENT DOCUMENTS

| | | | |
|---|---|---|---|
| 3,326,671 | 6/1967 | Worner . | |
| 3,449,117 | 6/1969 | Derham | 75/10 R |
| 3,555,164 | 1/1971 | Kostin et al. . | |
| 3,847,595 | 11/1974 | Liang et al. . | |
| 3,941,587 | 3/1976 | Queneau et al. . | |
| 3,948,640 | 4/1976 | Elvander et al. | 75/26 |
| 4,008,075 | 2/1977 | Petersson . | |
| 4,076,954 | 2/1978 | Linder . | |
| 4,087,274 | 5/1978 | Edenwall et al. . | |

FOREIGN PATENT DOCUMENTS 1179004 10/1964 Fed. Rep. of Germany .

OTHER PUBLICATIONS

J. Metals, 20 (12), 26–30 (1968).

*Primary Examiner*—M. J. Andrews

*Attorney, Agent, or Firm*—Burns, Doane, Swecker & Mathis

[57] ABSTRACT

The invention relates to a method for producing lead from sulphidic lead raw-materials by direct smelting processes of the kind in which the lead raw-materials are smelted autogenously in a shaft with the aid of oxygen gas, or air enriched in oxygen, optionally by adding fluxes, there being formed an oxide-containing molten product which is caused to pass into a coke bed arranged in the lower part of the shaft, to form a lead phase and a slag depleted in lead. The invention is characterized by heating the coke bed continuously, by partially combusting carbon therein and/or by supplying electrical energy thereto.

The electrical heating is preferably effected by supplying electrical energy through induction or through electrodes.

When heating the coke bed by the partial combustion of coke in the bed, oxygen gas or air enriched in oxygen is preferably introduced directly into the coke bed, through tuyeres or lances.

7 Claims, No Drawings

METHOD OF PRODUCING LEAD FROM SULPHIDIC LEAD RAW-MATERIAL

The present invention relates to a method for producing lead from sulphidic lead raw-materials by direct-smelting processes of the kind in which the lead raw-materials are smelted autogenously in a shaft to which oxygen gas or air enriched in oxygen is charged, optionally with an addition of fluxes, there being formed an oxide-containing molten product which is caused to pass into a coke bed arranged in the lower part of the shaft, to form a lead phase and a slag depleted in lead.

A number of autogenous smelting methods for the direct smelting of lead have been proposed in recent years. Direct lead smelting processes afford a number of advantages over the conventional method of producing lead, namely, the shaft-furnace smelting method. These advantages include:

(a) the elimination of sintering, including the elimination of re-cycling of large amounts of return sinter;
(b) a reduction of fuel requirements, due to the fact that the exothermic heat from the oxidation reaction processes is utilized to melt the raw materials;
(c) the possibility of using oxygen gas, or air enriched in oxygen, instead of atmospheric air; and
(d) the possibility of producing a gas which is much richer in sulphur dioxide than that which can be produced when sintering.

The direct lead smelting methods can, in principle, be divided into two groups; namely those which provide a slag of low lead content, which can be dumped, although at the cost of a lead bullion rich in sulphur, which bullion must often be subjected to separate treatment processes, for example, by conversion, and those which provide a lead phase which is low in sulphur, and a slag having a high lead content, which must be processed in a separate stage. This last-mentioned group includes the Outokumpu method (c.f. DE-C-1179004); the Cominco method (US-A-3847595); the St. Joseph Lead method (J. Metals, 20 (12), 26-30 (1968); the Worcra method (US-A-3326671); the Kivcet method (US-A-3555164); the Q-S method (US-A-3941587); and the Boliden Lead Kaldo Method (US-A-4008075).

Thus, it is in this latter type of direct smelting process that the lead sulphide is oxidized partially to lead, in accordance with the reaction $$PbS+O_2 \rightarrow Pb+SO_2 \quad (1)$$

and partially—quite substantially—to oxide, in accordance with the reaction $$PbS+3/2O_2 \rightarrow PbO+SO_2 \quad (2)$$

In the direct manufacturing methods which produce a lead phase low in sulphur and a slag having a high lead-oxide content, the original concept was to separate the lead phase from the lead-rich slag subsequent to the smelting process, and to process the slag in a separate reduction furnace, to recover the lead present in the slag. At least in those cases where relatively lean concentrates are smelted, i.e. concentrates having a low lead and/or sulphur content, which is possible and even highly advantageous in the case of direct smelting processes based on autogenous flame smelting in shafts, where the sulphur is driven off substantially in the shaft and thus not through a roasting and reaction process taking place on the surface of and within the bath, the amount of slag obtained, however, is so large that the costs involved in handling the slag are quite considerable and the environmental problems created so troublesome as to be prohibitive at times. In addition, slags having high lead-oxide contents deleteriously affect the furnace lining, so that slags having high lead-oxide contents are avoided to the greatest possible extent, in order to minimize the risk of damaging the shaft lining. This aim cannot be achieved while retaining a low sulphur content of the lead phase, unless the slag is chemically reduced at the same time as it collects in the lower part of the shaft. In recent times it has been proposed, in respect of methods of the aformentioned kind which utilize a shaft for the autogenous flame smelting of lead, to permit the substantially oxidic, molten product formed in the shaft to pass into a coke bed arranged in the lower part thereof. A large part of the lead oxide present in the product is reduced in this way, in accordance with the reaction.

$$PbO+C \rightarrow Pb+CO \quad (3)$$

enabling the lead-oxide content of the slag removed to be greatly decreased.

This reaction, however, is endothermic, and its heat of reaction is:

$$\Delta H_{298(3)}=27.8 \text{ kcal} \quad (3)$$

The lead oxide is also reduced to quite a significant extent with carbon monoxide formed in situ, according to the reaction:

$$PbO+CO \rightarrow Pb+CO_2 \quad (4)$$

Although this reaction is exothermic, with a heat of reaction $$\Delta H_{298(4)}=-13.4 \text{ kcal}$$

the carbon monoxide is still formed in this case in accordance with the endothermic reaction (3), and hence the "total reaction" for said reduction is still endothermic.

It will be seen from the aforegoing that the reduction of lead oxide in a coke bed in the shaft requires the supply of energy, and that this energy will be taken from the energy generated in the exothermic flame-smelting process. This is primarily effected by radiation downwardly from the upper parts of the shaft and probably, although to a much smaller extent, also through convection. i.e. by heat transfer from the process gas flowing down through the shaft in parallel flow with the furnace charge and solid reaction products. This means that a higher temperature must be obtained than would otherwise be necessary for the autogenous smelting process, since the reduction heat must also be supplemented through the generated roasting heat. This fact must be considered a serious and limiting disadvantage of such direct smelting methods as those modified with a coke bed in the smelting shaft, since excessively high temperatures quickly result in large heat losses, in addition to the high stresses and strains to which the apparatus is subjected. Consequently, the choice of smelting material is again restricted to the more concentrated materials, because the roasting heat generated will not otherwise be sufficient to melt the charge and to form a slag. If, on the other hand, the autogenous smelting temperature is permitted to be the same as that applied when operating without a coke bed in the shaft, there is a risk that the reduction in the coke bed will be incomplete, or insufficient, due to an energy deficiency. Thus, there is a need for improvement in the direct smelting processes of the aforedescribed kind, so that the disadvantages associated with direct coke reduction in the shaft are eliminated.

The object of the present invention is to provide a method for the direct smelting of lead, in which the molten bath can be reduced in direct connection with an autogenous smelting process in a shaft, without being encumbered with the disadvantages previously associated with such processes.

To this end the method according to the invention is characterized by the procedural steps set forth in the following claims.

Thus, by means of the method according to the invention it is possible to substantially increase the reduction efficiency of the coke bed, while at the same time enabling the amount of oxygen gas required for the autogenous smelting process to be greatly reduced, since the temperature in the flame can be lowered. This is achieved by continuously heating the coke bed with energy supplied from an external source. In this respect, the supply of energy is adapted so as to obtain the desired reduction work in the coke bed while maintaining the conditions in the remainder of the autogenous smelting process at the desired optimum. Thus, by heating the bed it is possible to provide all, or a substantial amount of energy required for the endothermic reduction of lead oxide to lead. In this respect, surplus heat can also be supplied to the shaft via the bed if so desired, in order to facilitate the smelting of leaner charges.

The coke bed can be heated by combusting coke therein, or by supplying electrical energy thereto. When using electrical energy, it is preferred that the energy is supplied by induction or through electrodes. The inductive heating of the coke bed can be suitably effected in the manner described in our earlier patent specification SE-B-7306063-4. Coke can be combusted in the bed by introducing oxygen gas, or air enriched in oxygen directly into the bed, through tuyeres or lances. The consumed coke can suitably be replaced by injecting coke directly into the bed.

The invention will now be described in more detail with reference to a working example, in which the method according to the invention is compared with methods forming part of the prior art.

EXAMPLE

Lead concentrate comprising mainly 64% Pb, 5% Zn, 7% Fe, 18% S and about 5% silica was charged at a rate of 20 tons per hour to a direct smelting plant for producing lead, said plant comprising a smelting shaft having a height of 4 m and a diameter of 2 m, the charge being autogenous-smelted in the shaft by charging thereto about 250 $Nm^3/t$ 95%-oxygen gas. By combusting sulphide sulphur in the concentrate, there was obtained in the shaft a combustion zone whose maximum temperature, reached at approximately 1.5 m from the top of the shaft, rose to approximately 1400° C. Lead sulphide and also zinc sulphide and iron sulphide, were oxidized in the combustion zone, to form $SO_2$ and a molten oxide-silicate bath in which a minor part of the lead charged was present in the form of metallic lead. Among other things, the molten furnace-contents contained about 15% metallic lead, about 60% lead oxide, and up to 10% magnetite. The sulphur content was relatively low, beneath 0.5%. The molten contents of the furnace were transferred to separate settling and reduction furnace, and there reduced with the aid of coke, to form about 13 ton/h lead phase containing 98.2% Pb, 0.5% Cu and 0.2% S, and about 6 ton/h slag containing, inter alia, 1.7% Pb, 15.6% Zn and about 1% S. About 1.1 tons of coke were consumed each hour.

The plant was modified for direct reduction in a heated coke bed in the shaft, in accordance with the invention. In this case, about 1.5 tons of coke were charged each hour to the lower part of the shaft, to maintain a coke bed of about 0.3 m. The bed was heated by injecting thereinto oxygen gas, in an amount of 350 $Nm^3/h$. In this way there was maintained by combustion a bed temperature of about 1200° C. As a result of the modification, it was possible to lower the amount of oxygen-gas charged to about 150 $Nm^3/t$, i.e. about 40% of the original charge, and the lead content of the slag was also lowered to 1.5%. A lead phase containing approximately the same amount of sulphur as the previous lead phase was separated from the slag, and the slag was directly transferred to a zinc-fuming plant, for fuming-off and recovering the zinc content of the slag.

I claim:

1. A method for producing lead from sulphidic lead raw material comprising:

(a) autogenously smelting the sulphidic lead raw material in a shaft in the presence of oxygen gas or air enriched in oxygen thereby forming an oxide-containing molten product;

(b) passing the oxide-containing molten product directly through a heated coke bed arranged in the lower part of the shaft thereby forming a molten lead phase and a slag phase depleted in lead, said coke bed being heated by at least one of partial combustion of carbon therein and electrical energy; and (c) recovering the molten lead phase.

2. The method of claim 1 wherein the coke bed is heated by electrical energy provided through induction or through electrodes.

3. The method of claim 2 wherein oxygen gas or air enriched in oxygen is introduced through tuyeres or lances directly into the coke bed.

4. The method of claim 1 wherein oxygen gas or air enriched in oxygen is introduced through tuyeres or lances directly into the coke bed.

5. A method of claim 3 wherein coke consumed in the bed is replaced by injecting additional coke directly into the bed.

6. The method of claim 1 wherein the sulphidic lead raw material is smelted in the presence of a flux.

7. The method of claim 1 wherein the coke bed is heated continuously.

* * * * *